US009737116B2

(12) United States Patent
Gibb et al.

(10) Patent No.: US 9,737,116 B2
(45) Date of Patent: Aug. 22, 2017

(54) FOOTWEAR RETENTION SYSTEMS

(71) Applicant: Vans, Inc., Cypress, CA (US)

(72) Inventors: Garrett Gibb, Costa Mesa, CA (US); Tristan Modena, Cypress, CA (US)

(73) Assignee: Vans, Inc., Costa Mesa, CA (US)

( * ) Notice: Subject to any disclaimer, the term of this patent is extended or adjusted under 35 U.S.C. 154(b) by 0 days.

(21) Appl. No.: 14/650,824

(22) PCT Filed: Dec. 13, 2013

(86) PCT No.: PCT/US2013/075151
§ 371 (c)(1),
(2) Date: Jun. 9, 2015

(87) PCT Pub. No.: WO2014/093905
PCT Pub. Date: Jun. 19, 2014

(65) Prior Publication Data

US 2015/0313318 A1 Nov. 5, 2015

Related U.S. Application Data

(60) Provisional application No. 61/737,700, filed on Dec. 14, 2012.

(51) Int. Cl.
*A43C 1/00* (2006.01)
*A43C 1/02* (2006.01)
(Continued)

(52) U.S. Cl.
CPC ..... *A43C 1/003* (2013.01); *A43B 5/0401* (2013.01); *A43B 5/0405* (2013.01); *A43B 23/26* (2013.01);
(Continued)

(58) Field of Classification Search
CPC .. A43C 1/003; A43C 1/00; A43C 1/02; A43C 11/00; A43C 11/1493; A43C 11/20; A43C 7/00; A43B 5/0401; A43B 5/0405
See application file for complete search history.

(56) References Cited

U.S. PATENT DOCUMENTS 4,748,726 A 6/1988 Schoch
5,341,583 A 8/1994 Hallenbeck
(Continued)

FOREIGN PATENT DOCUMENTS

CN 1081597 A 2/1994
CN 101048998 A 10/2007
(Continued)

OTHER PUBLICATIONS

Japanese Office Action in Japanese Patent Application No. 2015-548017 issued on Jul. 4, 2016.
(Continued)

*Primary Examiner* — Jila M Mohandesi
(74) *Attorney, Agent, or Firm* — Ganz Pollard LLC

(57) ABSTRACT

A retention system for footwear can include opposed closure elements and a tensioner configured to urge the opposed closure elements toward each other in response to a tensile force applied to the tensioner. Opposed first and second anchors can be spaced from the tensioner. A retainer can have opposed first and second retainer couplers. The first retainer coupler can operatively engage the first anchor and the second retainer coupler can operatively engage the second anchor such that a tensile load applied to one or both of the first and second retainer couplers urges the retainer toward one or both of the first and second anchors. Each of the retainer couplers can be operatively engaged with the tensioner such that a tensile load applied to the tensioner urges the first retainer coupler and the second retainer
(Continued)

coupler into tension and thereby urges the retainer toward one or both of the anchors.

14 Claims, 10 Drawing Sheets

(51) Int. Cl.

| | |
|---|---|
| ***A43C 11/00*** | (2006.01) |
| ***A43B 5/04*** | (2006.01) |
| ***A43C 11/14*** | (2006.01) |
| ***A43C 11/20*** | (2006.01) |
| ***A43B 23/26*** | (2006.01) |
| ***A43C 7/00*** | (2006.01) |

(52) U.S. Cl.
CPC ..... *A43C 1/00* (2013.01); *A43C 1/02* (2013.01); *A43C 7/00* (2013.01); *A43C 11/00* (2013.01); *A43C 11/1493* (2013.01); *A43C 11/20* (2013.01)

(56) References Cited

U.S. PATENT DOCUMENTS

| | | | | |
|---|---|---|---|---|
| 5,566,474 | A | 10/1996 | Leick et al. | |
| 5,692,319 | A * | 12/1997 | Parker | A43B 7/1495 36/114 |
| 5,933,985 | A | 8/1999 | James | |
| 5,937,542 | A | 8/1999 | Bourdeau | |
| 5,940,990 | A | 8/1999 | Barret | |
| 6,073,370 | A | 6/2000 | Okajima | |
| 6,076,241 | A | 6/2000 | Borel | |
| 6,119,372 | A | 9/2000 | Okajima | |
| 6,267,390 | B1 | 7/2001 | Maravetz et al. | |
| 6,367,169 | B1 | 4/2002 | Barret | |
| 6,467,193 | B1 | 10/2002 | Okajima | |
| 6,467,195 | B2 * | 10/2002 | Pierre | A43B 5/0447 36/50.5 |
| 6,473,999 | B2 | 11/2002 | Fellouhe | |
| 6,532,688 | B2 | 3/2003 | Bouvier | |
| 6,560,898 | B2 | 5/2003 | Borsoi et al. | |
| 6,775,928 | B2 | 8/2004 | Grande et al. | |
| 6,877,256 | B2 | 4/2005 | Martin et al. | |
| 6,993,859 | B2 | 2/2006 | Martin et al. | |
| 7,082,701 | B2 | 8/2006 | Dalgaard et al. | |
| 7,159,340 | B2 | 1/2007 | Borsoi | |
| 7,231,699 | B2 | 6/2007 | Borsoi | |
| 7,281,341 | B2 * | 10/2007 | Reagan | A43B 3/0031 36/50.1 |
| 7,293,373 | B2 | 11/2007 | Reagan et al. | |
| 7,360,282 | B2 | 4/2008 | Borsoi | |
| 7,386,947 | B2 * | 6/2008 | Martin | A43B 5/0401 36/10 |
| 7,392,602 | B2 | 7/2008 | Reagan et al. | |
| 7,401,423 | B2 | 7/2008 | Reagan et al. | |
| 7,591,050 | B2 | 9/2009 | Hammerslag | |
| 7,658,019 | B2 | 2/2010 | Reagan et al. | |
| 7,818,899 | B2 | 10/2010 | Dinndorf et al. | |
| 8,474,157 | B2 * | 7/2013 | Motawi | A43B 3/0031 36/117.1 |
| 8,713,820 | B2 * | 5/2014 | Kerns | A43B 3/0052 36/50.1 |
| 8,857,077 | B2 * | 10/2014 | Kahatsu | A43B 3/26 36/113 |
| 8,959,803 | B2 * | 2/2015 | Pelletier, Jr. | A43B 5/0401 36/50.5 |
| 2003/0115777 | A1 | 6/2003 | Hall et al. | |
| 2004/0074110 | A1 | 4/2004 | Borsoi | |
| 2006/0174516 | A1 | 8/2006 | Peruzzo | |
| 2006/0191164 | A1 | 8/2006 | Dinndorf et al. | |
| 2008/0028641 | A1 | 2/2008 | Messmer | |
| 2008/0163515 | A1 | 7/2008 | Rackiewicz et al. | |
| 2009/0090026 | A1 * | 4/2009 | Mosher | A43C 11/20 36/54 |
| 2013/0205622 | A1 | 8/2013 | Harald et al. | |

FOREIGN PATENT DOCUMENTS

| | | | |
|---|---|---|---|
| CN | 201948065 | U | 8/2011 |
| CN | 202184212 | U | 4/2012 |
| DE | 202008000952 | | 3/2008 |
| EP | 0923886 | | 12/2002 |
| EP | 1787541 | | 5/2007 |
| EP | 1882429 | A1 | 1/2008 |
| JO | 2004-041666 | | 2/2004 |
| JP | H06284907 | | 10/1994 |
| JP | H0852002 | A | 2/1996 |
| JP | 8317809 | | 3/1996 |
| JP | H10-155515 | | 6/1998 |
| JP | H11206416 | A | 8/1999 |
| JP | 3115773 | U | 11/2005 |
| JP | 2007136185 | A | 6/2007 |
| JP | 2013529994 | A | 7/2013 |
| WO | 2012001042 | | 1/2012 |

OTHER PUBLICATIONS

Office Action for Chinese Patent Application No. 201380065654.6 issued Apr. 22, 2016.
Extended European Search Report issued Nov. 18, 2016 in European Patent No. 13862930.8.
ISR/WO issued in PCT/US13/75151 on Apr. 28, 2014.
CIPO Office Action for Canadian Patent No. 2894713 issued Apr. 26, 2016.
Office Action dated Jan. 17, 2017 in Chinese Application No. 201380065654.6.
Office Action dated Feb. 15, 2017, in Canadian Application No. 2,894,713.

* cited by examiner

FOOTWEAR RETENTION SYSTEMS

RELATED APPLICATIONS

This application claims the benefit of and priority to U.S. Provisional Application Ser. No. 61/737,700, filed Dec. 14, 2012, the contents of which are hereby incorporated by reference as if recited in full herein for all purposes.

BACKGROUND

The innovations and related subject matter disclosed herein (collectively referred to as the "disclosure") generally pertain to retention systems for footwear, with a retention system configured to retain or immobilize an article of footwear relative to a wearer's foot and/or leg when the footwear is worn being but one example of disclosed retention systems. Some disclosed retention systems are particularly, but not exclusively, suitable for securing a sport boot to a wearer's foot and leg for use in a sport where relative movement (e.g., a sliding or a lifting movement) between the boot and the wearer's foot or leg is undesirable. For example, some disclosed retention systems are configured to retain a boot for a snow or a skating sport to a wearer's food and leg, in part by providing a closure system configured to urge the foot into the footbed and simultaneously urge the heel into the heel cup. In such sports, reduced or eliminated relative movement between the boot and the wearer's foot and leg provided by disclosed retention systems can improve power transfer between the wearer Systems that include a "cam-over" type of clamp positioned over the instep of a boot have been proposed for rigid ski boots. The retractable clamp constricts the rigid shell around the wearer's foot, urging the foot downwardly against the footbed and, to the extent the rigid shell might not be parallel to the footbed, rearwardly into the heel area. Such boots are made of stiff plastic parts and can have specially molded features for routing of tensioning cables to constrict the rigid shell around the wearer's foot. However, such boots may not allow for easy or precise adjustment of the cable tension. The integration of such systems into rigid-shell boot may also pose manufacturing challenges and may be costly.

A snowboard boot shell, in contrast to a rigid shell for a ski boot, typically has opposed, spaced apart edges and relatively lower stiffness. A tongue is usually positioned between and/or behind the opposed edges of the shell. In such boots, a lace or cable-based closure system may be used to draw the opposed edges of the shell together, constricting the shell around a wearer's foot and leg. Integrating and routing cable systems from molded, hard shell ski boots into relatively more flexible snowboard boots has proven difficult, in part, because the spaced apart edges of snowboard boot shells are generally incompatible with such closure systems.

A footwear tensioning system has been proposed for applying an instep force against an instep portion of a wearer's foot positioned in footwear in U.S. Pat. No. 7,818,899. In the '899 Patent, an article of footwear has an outer member, an inner lining, an instep member, and a lace. The outer member defines an outer surface of the item of footwear and the inner lining is positioned within the outer member. The instep member extends across an instep portion of the inner lining and the lace is routed through an anchor positioned adjacent the footbed and coupled to the instep member such that tension applied to the lace draws the instep member downward toward the footbed and rearward to the heel cup. However, the system described in the '899 Patent is not configured to constrict an outer shell of the footwear around the wearer's leg or to otherwise immobilize or inhibit movement of the footwear relative to the wearer's leg.

The foregoing is not intended to be an exhaustive listing of disadvantages of the prior art and needed improvements; it is only a sampling. In view of the foregoing and unlisted deficiencies in the prior art, a substantial need remains for improved footwear retention systems.

SUMMARY

Innovations disclosed herein overcome one or more problems in the prior art and address one or more of the aforementioned or other needs, and pertain generally to retention systems for footwear. For example, a retention system for footwear can include opposed constrictors and a tensioner configured to urge the opposed constrictors toward each other in response to a tensile force applied to the tensioner, and opposed first and second anchors spaced from the tensioner. A retainer can have opposed first and second retainer couplers. The first retainer coupler can operatively engage the first anchor, and the second retainer coupler can operatively engage the second anchor, such that a tensile load applied to one or both of the first and second retainer couplers urges the retainer toward one or both of the first and second anchors. Each of the first retainer coupler and the second retainer coupler can be operatively engaged with the tensioner such that a tensile load applied to the tensioner urges the first retainer coupler and the second retainer coupler into tension, and thereby urges the retainer toward one or both of the first and second anchors.

In some instances, the opposed constrictors can include opposed first and second closure elements. The tensioner can include a lace operatively extending between the first and the second closure elements such that a tensile load applied to the lace urges the first and the second closure elements toward each other. The opposed first and second retainer couplers can include respective first and second strap segments. The opposed first and second anchors can include respective first and second apertured members. The operative engagement between the first retainer and the first anchor can include the first strap segment extending through and urging against the first apertured member.

In other instances, the opposed first and second anchors can include respective first and second apertured members, and the retainer can include a portion of a tongue member. The opposed first and second retainer couplers can include respective first and second strap segments outwardly extending from the tongue member and through the apertured members. The operative engagement between the first retainer coupler and the tensioner can include a first slidable engagement of the first strap member with the tensioner, and the operative engagement between the second retainer coupler and the tensioner can include a second slidable engagement of the second strap member with the tensioner.

In some instances, the first and second closure elements can include respective first and second eyerows. The opposed first and second eyerows, the lace, and the first and second strap portions can be positioned inwardly of at least a portion of the retainer relative to a user's foot when the footwear is donned.

The opposed constrictors, the tensioner, and the first and second strap segments can be positioned inwardly of the tongue member relative to a user's foot when the footwear is donned.

The opposed constrictors can include opposed first and second eyerows positioned adjacent respective first and second opposed edges of a harness member. The opposed first and second anchors can be fixedly coupled to the footwear such that the first and the second retainer couplers are positioned inwardly of the footwear relative to a user's foot when the footwear is donned.

The footwear can include an outer shell member and the harness member can include an inner harness member. The opposed first and second anchors can be positioned between the outer shell and the inner harness member in an opposed relationship with each other.

The opposed constrictors can include inner closure elements and the tensioner can include an inner tensioner positioned inwardly of the retainer relative to a user's foot when the footwear is donned. Such a retention system can also include opposed outer closure elements and an outer tensioner. Each of the opposed outer closure elements and the outer tensioner can be positioned outwardly of the retainer relative to the user's foot when the footwear is donned. The outer tensioner can be configured to urge the opposed outer closure elements toward each other in response to a tensile force applied to the outer tensioner, and thereby to supplement a retention force applied to the users foot as a result of the tension force applied to the inner tensioner.

The opposed outer closure elements can include respective opposed first and second outer eyerows and the outer tensioner can include an outer lace operatively extending through the opposed first and the second outer eyerows such that a tensile load applied to the outer lace urges the first and the second outer eyerows toward each other.

Inner closure elements can include respective opposed first and second inner eyerows, and the inner tensioner can include an inner lace operatively extending through the opposed first and the second inner eyerows such that a tensile load applied to the inner lace urges the first and the second inner eyerows toward each other. The opposed first and second retainer couplers can include respective first and second strap segments and the opposed first and second anchors can include respective first and second apertured members. The operative engagement between the first retainer and the first anchor can include the first strap segment extending through and urging against the first apertured member.

In other instances, the opposed first and second anchors can include respective first and second apertured members. The retainer can include a tongue member and the opposed first and second retainer couplers can include respective first and second strap segments extending outwardly from the tongue member and through the apertured members. The operative engagement between the first retainer coupler and the inner tensioner can include a first slidable engagement of the first strap member with the inner tensioner, and the operative engagement between the second retainer coupler and the inner tensioner can include a second slidable engagement of the second strap member with the inner tensioner. The first and second strap portions can be positioned inwardly of at least a portion of the retainer relative to a user's foot when the footwear is donned. The first and second strap segments can be positioned inwardly of the tongue member relative to a user's foot when the footwear is donned.

In other instances, the inner closure elements can include respective opposed first and second inner eyerows positioned adjacent corresponding first and second opposed edges of an inner harness member. The inner harness member can be positioned inwardly of at least a portion of the retainer relative to a user's foot when the footwear is donned.

The opposed first and second anchors can be fixedly coupled to the footwear such that the first and the second retainer couplers are positionable inwardly of the footwear relative to a user's foot when the footwear is donned.

The footwear can include an outer shell member and the harness member can be an inner harness member. The opposed first and second anchors can be positioned between the outer shell and the inner harness member in an opposed relationship with each other.

In another respect, retention mechanisms for footwear having an outer shell and an inner liner positioned within the outer shell are disclosed. The retention system can include opposed first and second inner closure elements positioned between the outer shell and the inner liner. An inner lace can operatively extend between and engage the opposed first and the second inner closure elements. The inner lace can be configured to urge the opposed first and second inner closure elements toward each other in response to a tensile force applied to the inner lace. Opposed first and second anchors can be spaced from the inner lace and positioned outwardly of the inner liner. A retainer can have opposed first and second strap segments extending outwardly from the retainer. The first strap segment can slidably extend through the first anchor and have a corresponding distal eyelet. The second strap segment can slidably extend through the second anchor and have a corresponding distal eyelet. The inner lace can slidably extend through the distal eyelet corresponding to the first strap segment and through the distal eyelet corresponding to the second strap segment such that the inner lace is configured to urge the distal eyelet corresponding to the first strap segment and the distal eyelet corresponding to the second strap segment toward each other to urge the retainer toward the opposed first and second anchors. Opposed first and second outer closure elements can be positioned outwardly of the retainer relative to the inner liner. An outer lace can operatively extend between and engage the opposed first and second outer closure elements to urge the opposed first and second outer closure elements toward each other and such that the outer lace is configured to urge the retainer inwardly toward the liner in response to a tensile force applied to the outer lace.

An inner harness can be positioned between the outer shell and the inner liner and extend at least partially around the inner liner. The opposed first and second inner closure elements can be positioned adjacent respective opposed first and second edges of the inner harness.

The retainer can include a tongue member configured to overlie at least a wearer's instep outwardly of the inner liner and inwardly of the opposed first and second outer closure elements when the footwear is worn. The retainer can include an intermediate strap segment extending between the opposed first and second strap segments. The intermediate strap segment, the opposed first and second strap segments, and the opposed first and second anchors can be cooperatively configured to urge the intermediate strap inwardly toward the inner liner when the distal eyelet corresponding to the first strap segment and the distal eyelet corresponding to the second strap segment urge toward each other.

The retainer can further include an intermediate strap segment extending between the opposed first and second strap segments. The intermediate strap segment can be fixedly coupled with the tongue member. The opposed first and second strap segments and the respective anchors can be so configured as to urge the tongue member toward the wearer's instep as the opposed first and second strap segments urge toward each other.

The opposed first and second anchors can include respective first and second apertured members substantially fixedly positioned relative to the outer shell. Each of the first and second apertured members can be an eyelet, a D-ring, or an O-ring. The outer shell can include a lining and each of the opposed first and second anchors can include a respective anchor strap sewn to the lining. Each respective anchor strap can have an eyelet matingly engaged with the respective apertured member to thereby fixedly position the respective apertured member relative to the outer shell.

Other innovative aspects of this disclosure will become readily apparent to those having ordinary skill in the art from a review of the following detailed description (and accompanying drawings), wherein various embodiments of disclosed innovations are shown and described by way of illustration. As will be realized, other and different embodiments systems incorporating the disclosed innovations are possible and several disclosed details are capable of being modified in various respects, all without departing from the spirit and scope of the principles disclosed herein. For example, the detailed description set forth below in connection with the appended drawings is intended to describe various embodiments of the disclosed innovations and is not intended to represent the only embodiments contemplated by the inventors. Instead, the detailed description includes specific details for the purpose of providing a comprehensive understanding of the principles disclosed herein. Accordingly the drawings and detailed description are to be regarded as illustrative in nature and not as restrictive in nature.

BRIEF DESCRIPTION OF THE DRAWINGS

Unless specified otherwise, the accompanying drawings, wherein like numerals represent like features throughout, illustrate aspects of the innovative subject matter described herein.

DETAILED DESCRIPTION

The following describes various principles related to retention systems for footwear, with retention systems for snowboarding boots being but one particular, but not exclusive, example of innovative retention systems disclosed herein. One or more of the principles can be incorporated in various retention system configurations to achieve any of a variety of retention system characteristics. Retention systems described in relation to particular boot configurations, applications, or uses, are merely examples of retention systems incorporating the innovative principles disclosed herein and are used to illustrate one or more innovative aspects of the disclosed principles.

OVERVIEW

For illustrative purposes, a snowboard boot will be used as a representative footwear in which the inventive subject matter may be embodied. From the following discussion, persons skilled in the art will understand how the inventive subject matter may be embodied in other forms of boots and footwear.

Figure 1:
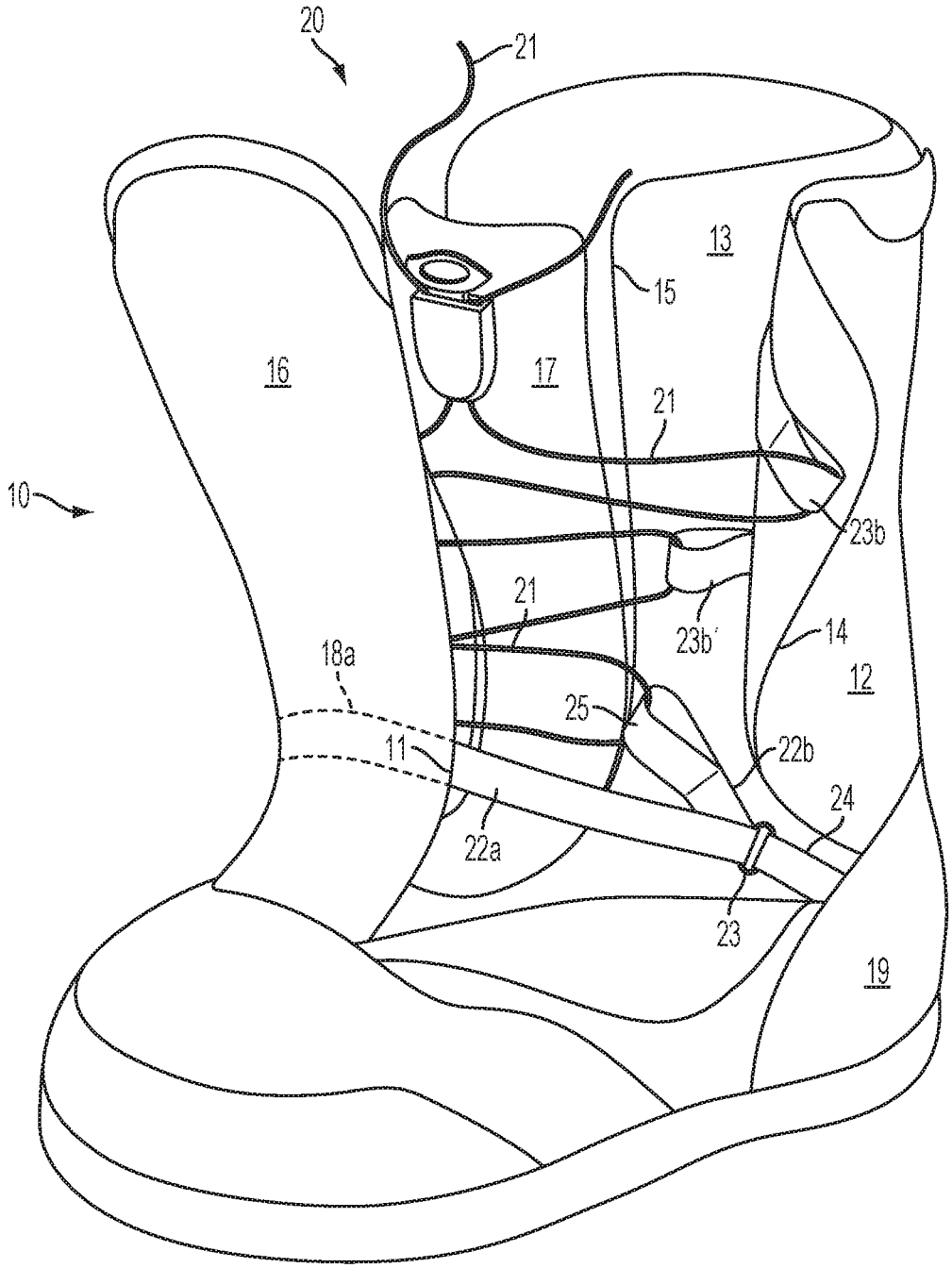
FIG. 1 illustrates an isometric view from a position in front of and lateral to a boot having an innovative retention system in a loosened configuration.

FIG. 1 shows aspects of a boot 10 having an innovative retention system 20. The retention system 20 is configured to close a portion of the boot 10 around a wearer's foot and/or leg, retaining or immobilizing the item of boot 10 relative to the wearer's foot and/or leg. The retention system 20 is particularly, but not exclusively, suitable for securing a sport boot to the wearer's foot and leg for use in sports where relative movement (e.g., a sliding or a lifting movement) between the boot and the wearer's foot or leg is undesirable.

The boot 10 shown in FIG. 1 has an outer shell 12 and an inner liner 13 positioned within the outer shell in a mating engagement. The outer shell 12 defines opposed, spaced apart edges 14. A tongue 16 of the outer shell 12 can be positioned between the edges 14 and can overlie the instep of a wearer's foot and a portion of the wearer's foreleg, outwardly of a liner tongue 17. The tongue 16 can constitute part of the outer shell 12 or can be coupled to another structure in the boot, e.g., the sole or a strobel.

Figure 11:
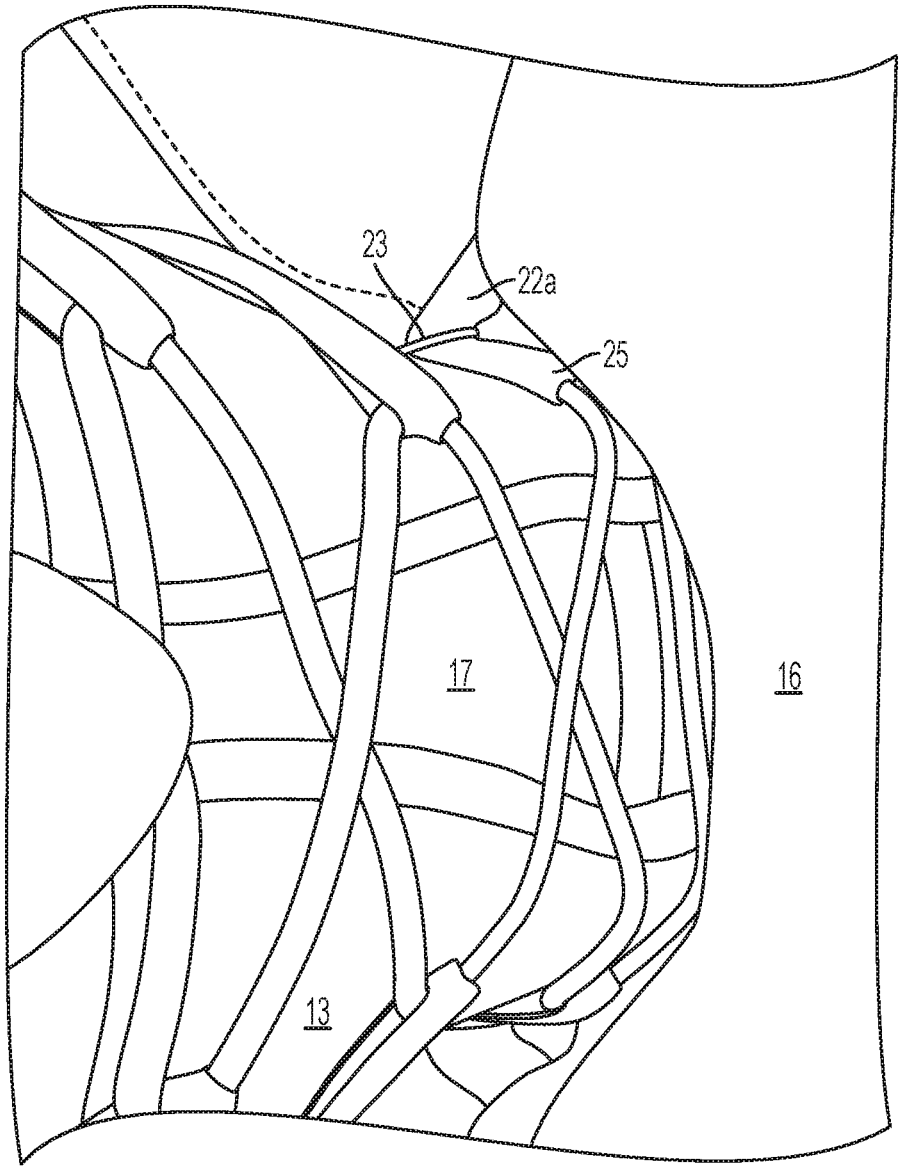
FIG. 11 illustrates a view, from a user's perspective, of the working embodiment of the footwear shown in FIG. 10 being worn.

Similar to the tongue 16 of the outer shell 12, the liner tongue 17 can be positioned between opposed, spaced apart edges 15 of the inner liner 13. The outer shell 12 and the inner liner 13 are complementarily configured as to receive a wearer's foot and leg (not shown) within the liner (e.g., see FIG. 11).

In the boot 10 embodiment illustrated in FIG. 1, the retention system 20 includes a lace 21 alternatingly extending through opposed first and the second closure elements (in some instances, an inner eyerow can constitute a closure element) positioned inwardly of the outer shell 12 and adjacent a respective opposed edge 14. Each of the opposed inner closure elements has a corresponding plurality of eyelets 23*b*, 23*b'*.

The retention system 20 also has opposed first and second anchors 23 spaced from the lace 21 and positioned outwardly of the inner liner 13 and inwardly of the outer shell 12. Opposed first and second strap segments 22*a* extend outwardly from the tongue 16, e.g., from an edge 11 of the tongue. As shown in FIG. 1, a strap segment 22*a* can extend to strap segment 22*b*, by slidably extending through a corresponding one of the anchors 23. The strap segment 22*b* can have a corresponding distal eyelet 25 through which the lace 21 slidably extends. Strap segment 22*b*, can extend in a non-parallel direction relative to the strap segment 22*a* after passing through the anchor 23, allowing tension in the strap segments 22*a*, 22*b* to apply a resultant force to the anchor 23 in a direction parallel to neither the strap segment 22*a* nor the strap segment 22*b*.

Figure 2:
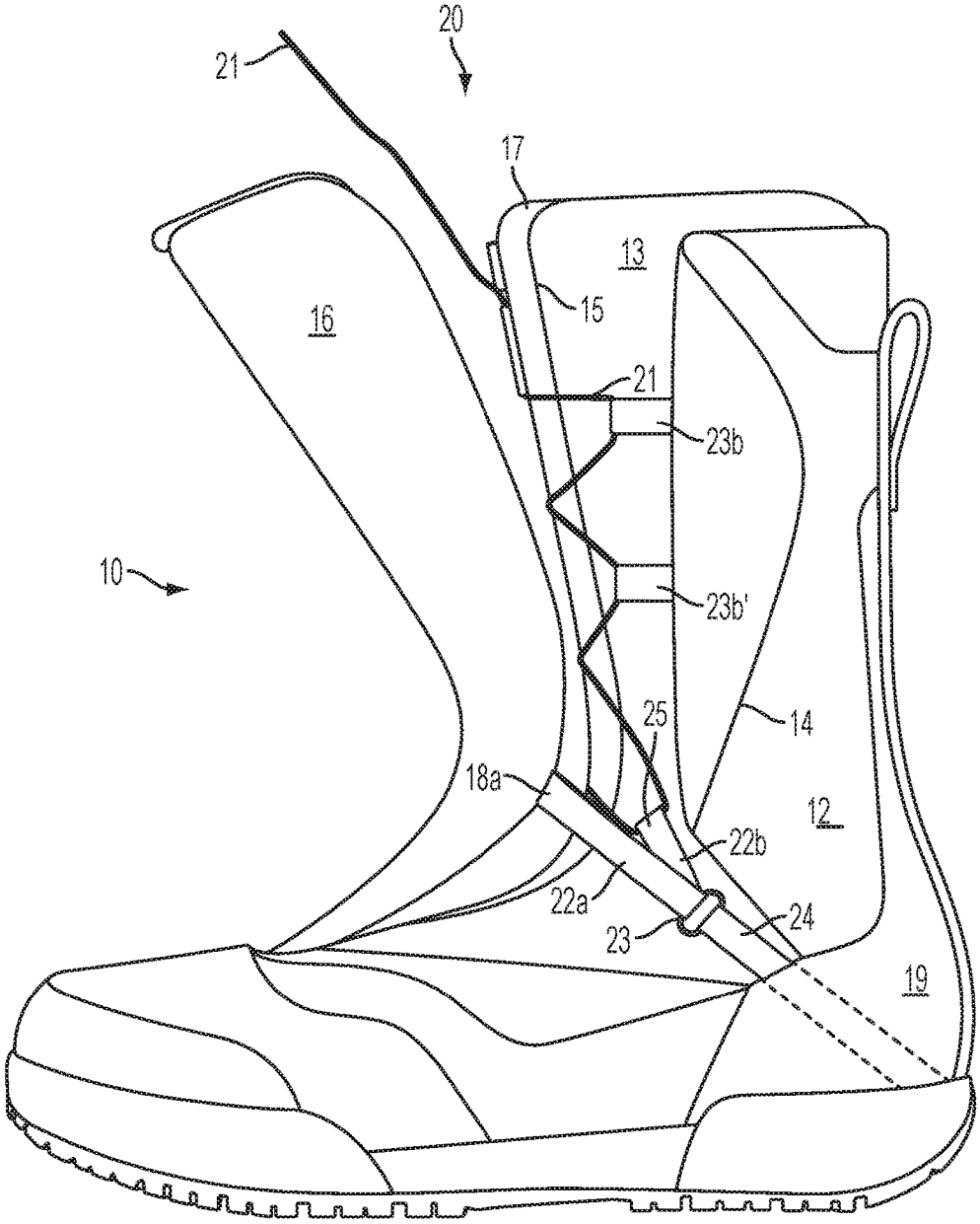
FIG. 2 illustrates a side elevation view of a boot configured as shown in FIG. 1.
Figure 3:
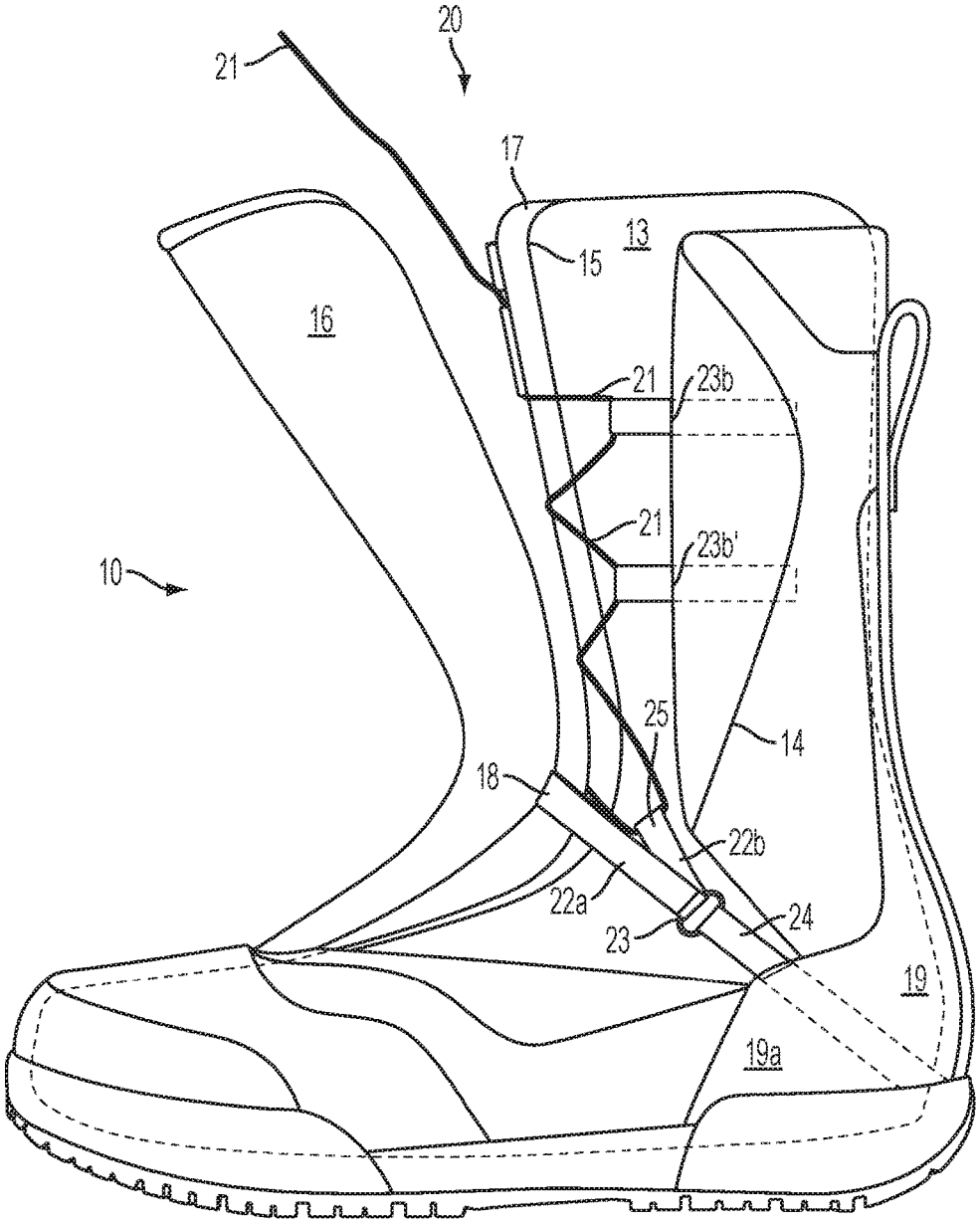
FIG. 3 illustrates a side elevation view of the boot and retention system configured as shown in FIG. 2, showing a portion of an outer shell as translucent to reveal an inner liner inserted into the outer shell.

Tensioning the lace 21 can urge the first and second inner closure elements toward each other, as shown for example in FIGS. 2 and 3. In addition, tensioning the lace 21 can draw the opposed distal eyelets 25 of the strap segments 22*b* toward each other, placing one or both of the opposed strap segments 22*a* in tension. Such tension in the strap segment 22*a* can urge the strap segment through the anchor 23 and draw at least a portion of the tongue 16 toward the anchor 23, causing the tongue 16 to urge against the inner liner 13, the liner tongue 17, or both, applying a downward and rearward force to a wearer's foot (not shown) in a direction generally parallel to the strap segment 22*a* between the tongue and the anchor, and tending to urge the wearer's foot downward toward the footbed and rearward toward the heel region 19. The heel region 19 can include a heel cup.

Figure 4:
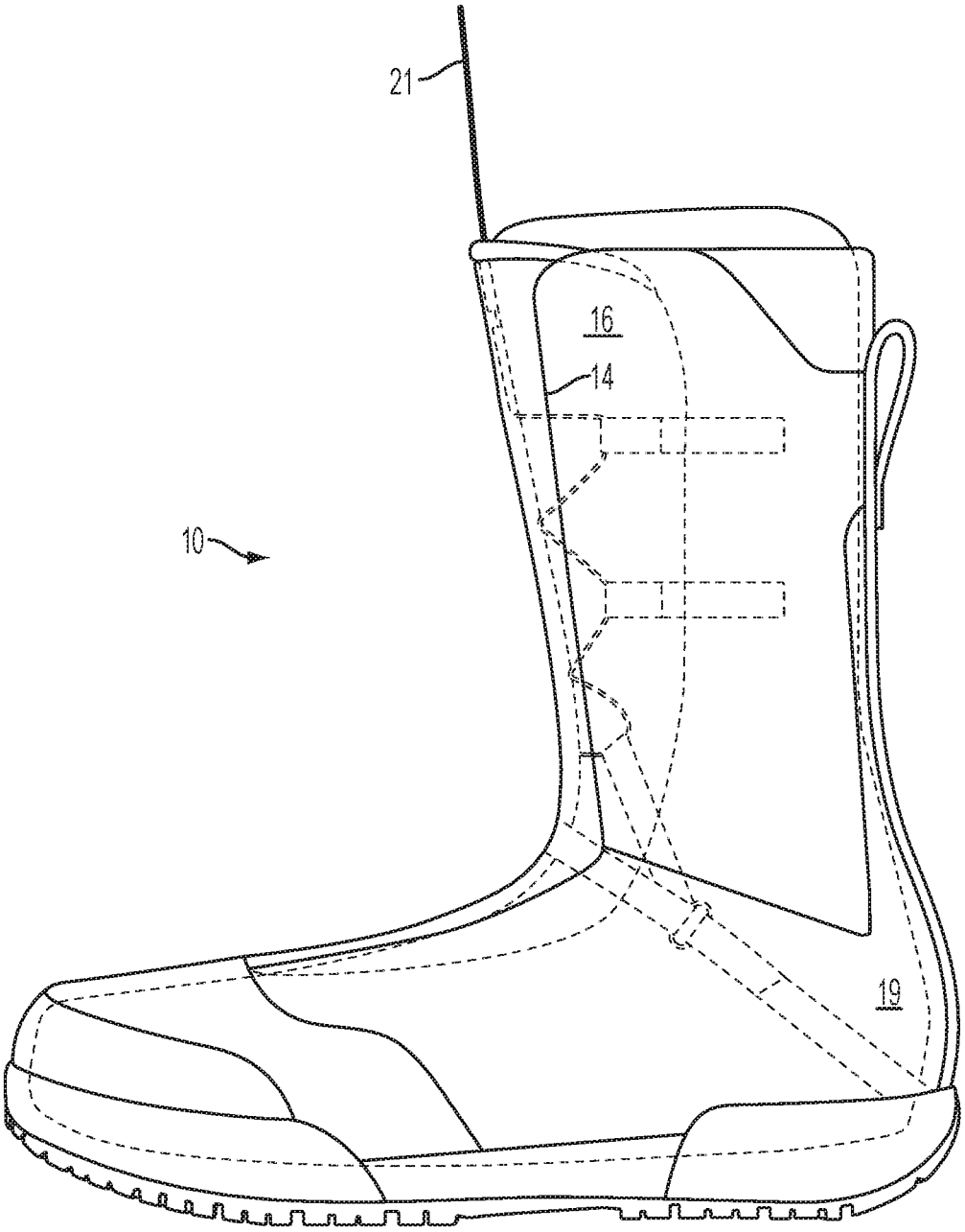
FIG. 4 illustrates a side elevation view of the boot and retention system shown in FIGS. 2 and 3 with the retention system shown in a tightened configuration and the outer shell shown as being translucent to reveal the inner liner and retention system.
Figure 5:
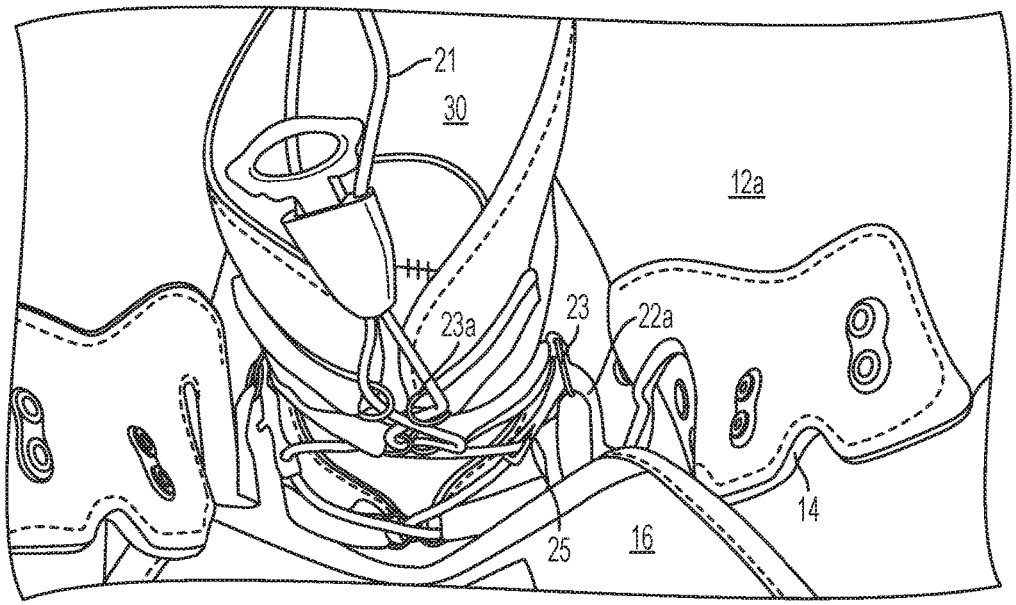
FIG. 5 illustrates a view from above and in front of a working embodiment of a boot having an innovative retention system of the type disclosed herein. Unlike the embodiments shown in FIGS. 1, 2, 3 and 4, the working embodiment shown in FIG. 5 includes an inner harness body.

In some embodiments, the outer shell 12 includes an outer eyerow positioned adjacent each of the opposed edges 14, as shown by way of example in FIG. 5. An outer lace (not shown) can alternatingly extend through opposed first and second outer eyerows. Tensioning the outer lace can urge the opposed first and second outer eyerows of the shell toward each other and thereby urge the tongue 16 inwardly toward the liner tongue 17, supplementing a downward and rearward force applied to the tongue by the tensioned strap segments 22*a*. A representative example of a closed boot 10 is shown in FIG. 4.

Outer Shell and Inner Liner

A snowboard boot 10 typically has an outer shell 12. The outer shell 12 is typically a semi-rigid structure made of an assembly of materials, such as one or more of sheets or layers of leather, woven or non-woven textiles, and plastics and rubbers. Some or all of the shell may be made of molded plastics or rubbers.

The boot may have an inner liner 13, which is usually a removable bootie but it can also be built into the outer shell 12. A footbed for receiving the bottom of the user's foot is part of the boot, and may be formed in the liner material or it may be a separate structure. The boot also includes a heel region 19 for wrapping around and receiving the heel of a wearer's foot. The heel region 19 (e.g., a heel cup) is typically formed in the inner liner 13. In the representative boot embodiments shown in the drawings, opposed edges 14 of outer shell 12 are spaced apart from each other and in-filled by tongue 16.

The outer shell includes an upper portion that extends upward from the instep, over the ankle, and around a lower leg portion of a user. The outer shell 12 also includes a proximal foot enclosure portion enclosing the general areas of the instep and heel and a distal portion for enclosing the top and sides of the midfoot and forefoot.

The boot 10 includes a sole that connects to or is integral with the outer shell 12 and covers the bottom of the user's foot. The sole may be made of rubber, EVA, PU and other known midsole and outsole materials alone or in combination. The shell and soles may be lasted together using any known or developed techniques, including board lasting.

The outer shell 12 in a snowboard boot is made up of relatively stiff and rugged materials, such as leathers (e.g., natural leathers, synthetic leathers, or both) and semi-rigid or rigid plastics, rubbers, or other such materials. The shell may include an inner that is typically made up of a thickened set of materials that provide cushioning, comfort, and insulation to a user's foot. For example, the liner may be made of a core of foamed polyurethane PU or ethyl vinyl acetate EVA materials with outer and inner linings of a textile or fabric. The inner liner 13 may also be separate removable component such as a bootie. The tongue 16 or tongue region of the boot may be molded or otherwise be formed similar to the shell. The liner can also have a liner tongue 17. A liner tongue can have a construction similar to a construction of the liner.

Boot 10 has a flex zone laterally outward of and generally corresponding to a position of an intended wearer's ankle joint. The ankle joint is the hinging joint between the foot and the leg. The uppermost bone of the foot, called the talus (ankle-bone), is disposed between the two bony protuberances formed by the lower ends of the tibia (shin bone) and the fibula. By constricting the boot around the region of an intended wearer's ankle's hinge joint, retention system can cause the boot to be immobilized over the wearer's foot and leg, allowing for precise and controlled flexation and transmission of power to, for example, a snowboard.

Optional Inner Harness Body

Figure 6:
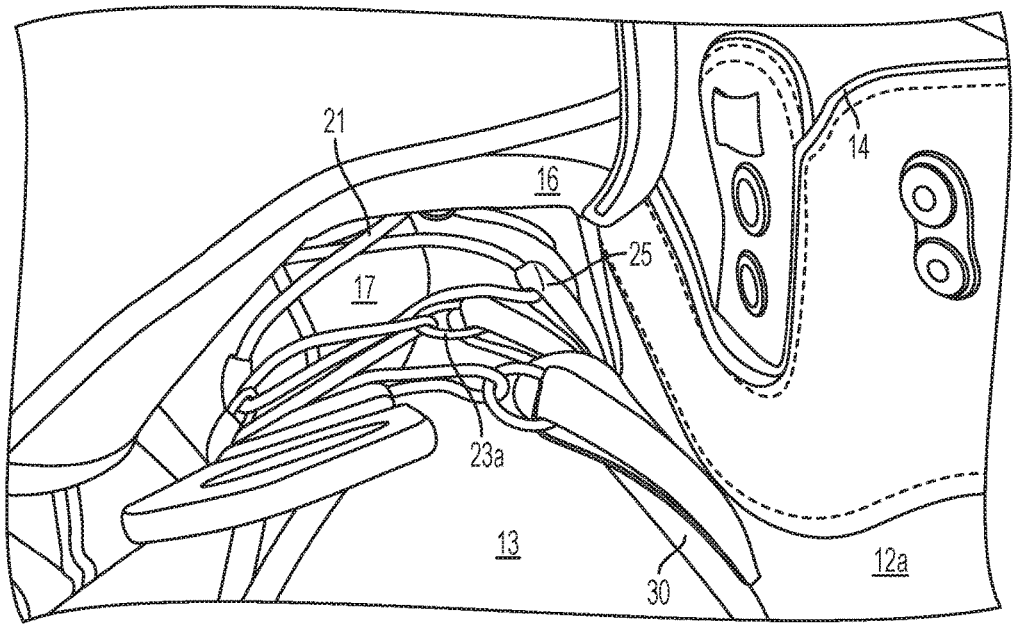
FIG. 6 illustrates the working embodiment of disclosed footwear shown in FIG. 5 being worn, from a user's perspective. The retention system is partially but not fully tightened.
Figure 7:
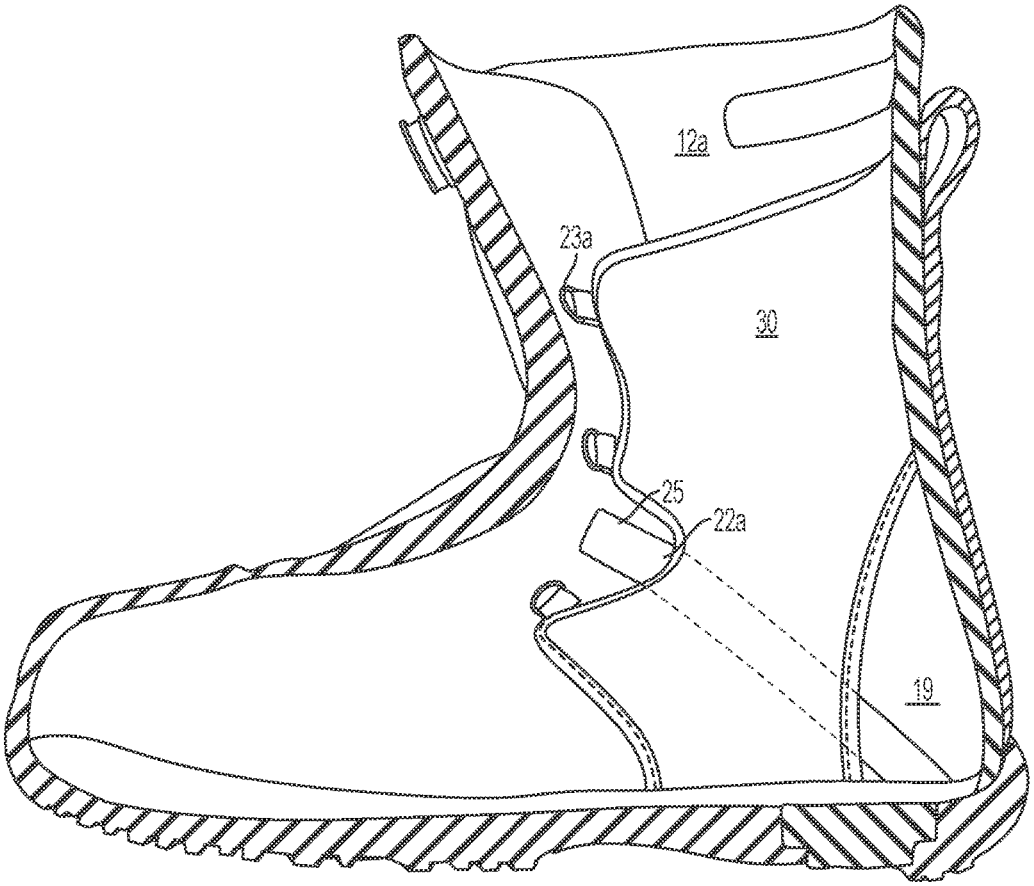
FIG. 7 illustrates a side elevation view of a sectioned working embodiment of footwear similar to that shown in FIG. 6 and revealing features of the retention system and the inner harness.
Figure 8:
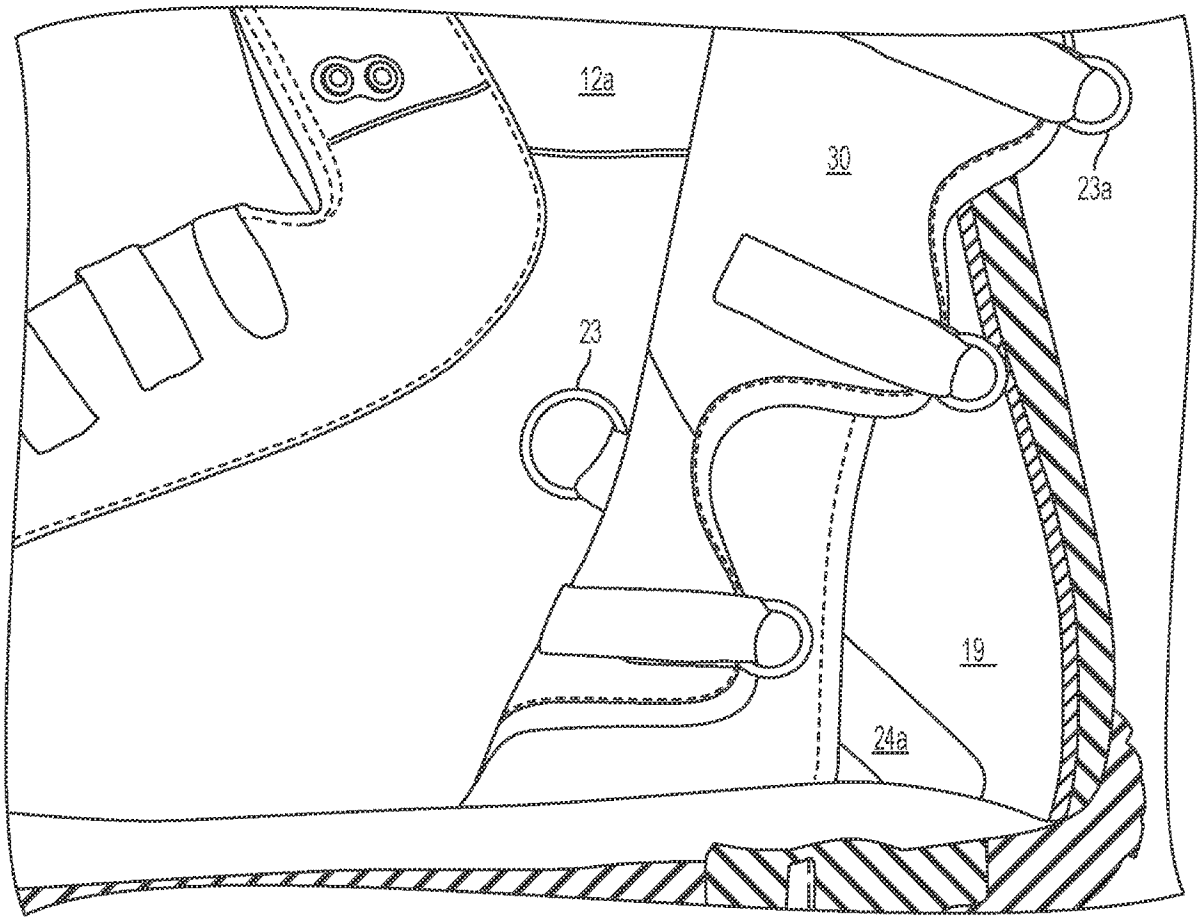
FIG. 8 illustrates a portion of the sectioned working embodiment shown in FIG. 7 with a portion of the inner harness and features of the retention system manipulated to reveal features not shown in FIG. 7.
Figure 9:
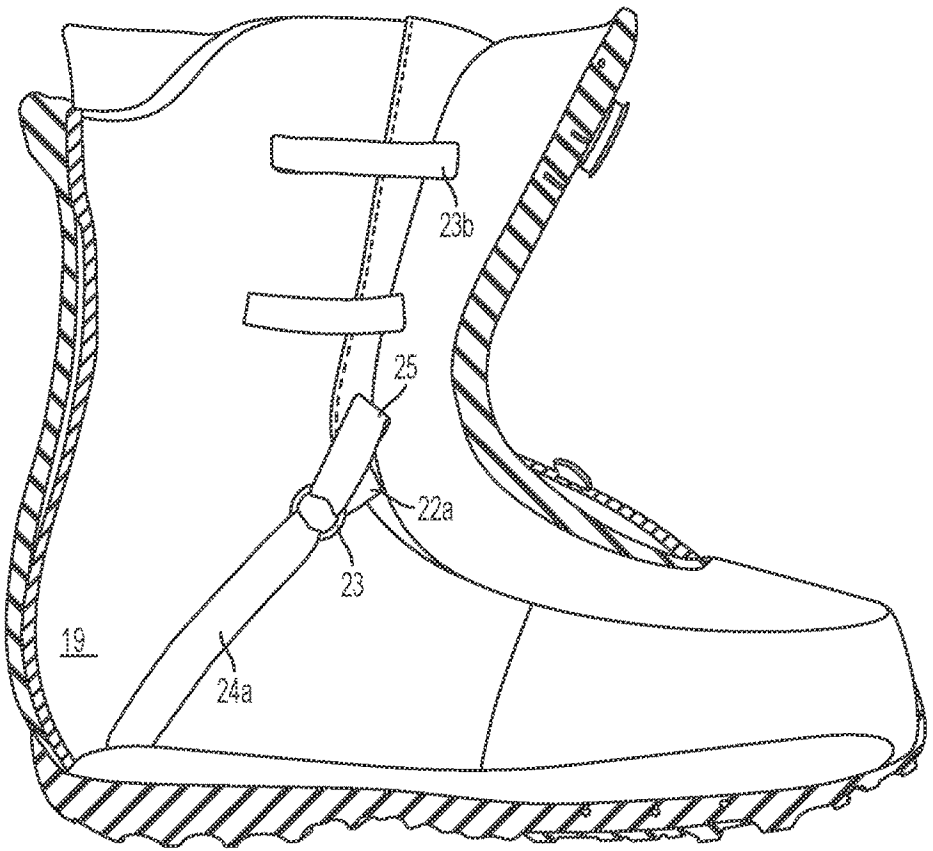
FIG. 9 illustrates a side elevation view of a sectioned working embodiment of footwear similar to that shown in FIGS. 2, 3 and 4 and revealing features of the retention system.
Figure 10:
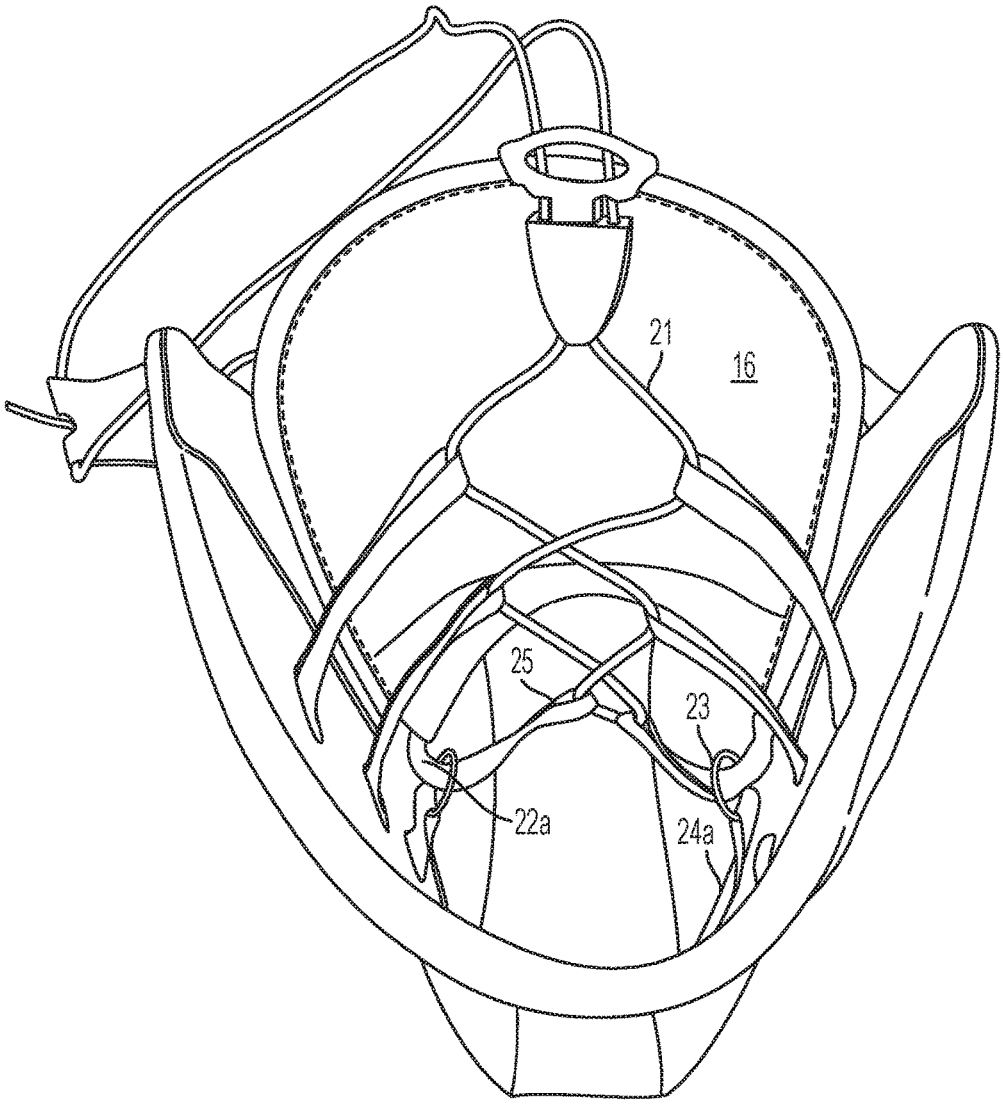
FIG. 10 illustrates a view from above a complete working embodiment of the type shown in FIG. 9.

Unlike the boot 10 shown in FIG. 1, the working boot embodiment pictured in FIG. 5 has an inner harness body 30 positioned within the outer shell. Such a harness body is optional and not required, as indicated by comparing the working embodiments shown in FIG. 5 and, for example, FIG. 10. As shown in FIG. 6, the inner harness body 30 can be configured to overlie an inner liner 13 of the type shown schematically in and described in relation to FIGS. 1 through 4.

As shown in FIGS. 5 through 8, opposed pluralities of eyelets 23*a* constituting respectively opposed first and the second closure elements (sometimes referred to herein as "constrictors") can extend from an inner harness body 30. Tensioning the lace 21 can urge the first and second inner closure elements extending from the harness, and thus opposed edges of the inner harness body 30, toward each other, as shown for example in FIGS. 5 and 6.

Retention System Embodiments

In general, an innovative retention system 20 can include a closure configured to constrict one or more portions of the boot 10 around a wearer's leg and/or foot. For example, a common closure system for a snowboard boot can includes opposed constrictors (or closure elements) and a tensioner configured to urge the opposed constrictors toward each other in response to a tensile force applied to the tensioner.

As used herein, a "constrictor" refers to any structure or member configured to constrict a portion of an article of footwear around a corresponding portion of a wearer's foot, ankle, and/or leg.

As used herein, a "tensioner" refers to any structure or member configured to urge against a portion of an article of footwear when placed under a tensile load.

In some representative embodiments, the tensioner is configured as a lace 21, and the opposed constrictors are configured to slidably engage the lace. As but one example, the opposed constrictors can include opposed eyerows having respective pluralities of eyelets 23*a*, 23*b*, as shown in FIGS. 1 through 6. The eyelets 23*a*, 23*b*, can be fixedly coupled with a portion of the footwear (e.g., a liner, a shell, a harness body). As an example, a strap having a distal eyelet 23*b* can be sewn to an inner liner of the outer shell (FIG. 1), or a strap having a distal eyelet 23*a* can be sewn to an inner harness body 30 (FIG. 5).

Other forms of constrictors are possible. For example, some constrictors can be configured as hooks fixedly attached to the outer shell 12, the inner liner 13 or an optional inner harness body 30. Other constrictors include latches, hook-and-loop fasteners extending through an apertured ring, etc.

Innovative retention systems can also include a retainer 18*a* (FIG. 1) configured to overlie an instep of an intended wearer's foot when the boot 10 is worn. In some instances, the retainer 18*a* constitutes a portion of a tongue 16. Opposed first and second retainer couplers, e.g., strap segments 22*a*, 22*b* (FIG. 2) can extend outwardly from the retainer 18*a*. The retainer 18*a* can be fixedly coupled with, or integral with, the retainer couplers (e.g., strap segments 22*a*). For example, a retainer 18*a* can include a strap of fabric, leather or other suitable material sewn, riveted or otherwise fixedly attached to or integrated with the tongue 16.

In some instances, the retainer 18*a* is configured as an intermediate strap (FIG. 1) extending between proximal ends of the opposed and outwardly extending first and second retainer couplers (e.g., strap segments 22*a*). As an example, the intermediate strap can constitute an intermediate segment of a continuous strap extending between eyelets 25 positioned at opposing ends of the strap. Stated differently, the intermediate strap can form a unitary construction with, and thus be an intermediate segment of, a continuous strap. In other embodiments, an intermediate strap can constitute a structure independent of the outwardly extending retainer couplers. For example, a portion of the tongue 16 can define the retainer 18*a*.

In addition to a closure and a retainer, innovative retention systems 12 can include opposed first and second anchors 23 spaced from the tensioner. The anchors 23 can permit the retainer couplers, e.g., the strap segments 22*a* to operatively couple the retainer and the closure to each other. In the illustrated embodiments, the anchors 23 allow a tensile member (e.g., a compliant strap) to bend and thus allow a tensile force applied along the tensile member to act on one or more portions of the boot 10 in a resultant direction other than parallel to the tensile member. For example, in FIG. 2, the tensile member (or retainer coupler) includes strap segments 22*a* and 22*b*. The tensile member extends through and bends around the anchor 23 (e.g., the anchor 23 can be configured as a D-ring or an O-ring or other apertured member), causing strap segments 22*a*, 22*b* of the tensile member on opposed sides of the anchor to form an acute angle relative to each other. Since the direction of a tensile force applied to a tensile member (such as a compliant strap or a lace) is parallel to a longitudinal axis of the tensile member, tensile forces within the tensile member are parallel to the tensile member.

The tensile force in the strap segment 22*a* of the tensile member extending between the anchor 23 and the edge 11 of the tongue 16 acts along the strap segment 22*a*. Similarly, the tensile force in the strap segment 22*b* of the tensile member extending between the anchor 23 and the lace 21 (e.g., the eyelet 25), as shown in FIG. 2, acts along the strap segment 22*b*. Since the strap segments 22*a* and 22*b* form an acute angle relative to each other, the resultant force vector applied by the strap segments 22*a*, 22*b* on the anchor 23 lies parallel to neither of the strap segments 22*a*, 22*b*. Nonetheless, the tensioner (e.g., lace 21) and anchor 23 place the strap segment 22*b* in tension. The tension force (net of friction between the strap segments and anchor 23) continues into strap segment 22*a*, urging the tongue 16 toward the anchor 23 (e.g., parallel to strap segment 22*a*). Taking an alternative view, placement of the anchors 23 in a spaced apart relation from the lace 21 and edge 11 of the tongue 16 can draw the tongue downward and rearward in a desired direction (e.g., parallel to strap segment 22*a*) in response to tensioning of the lace 21.

In some instances, a retention system of the type disclosed herein can cause the tongue 16 to urge a wearer's foot downward and rearward in a direction generally parallel to a line between a wearer's talus and heel protrusion. Relative placement of the anchor 23, retainer and eyelet 25 can be selected to cause the retainer to urge a wearer's foot and/or foreleg in a predetermined downward and rearward direction relative to the boot.

Suitable anchors 23 can be configured to slidably engage or rollingly urge against an elongate retainer coupler, such as the strap segments 22*a*, 22*b*. As shown in the accompanying drawings, an anchor 23 can be configured as a D-ring or an O-ring (or other apertured member), preferably having a relatively low coefficient of friction in relation to a material selected for the strap segments 22*a*, 22*b*. Alternatively, an anchor 23 can be configured as a suitable pivot device configured to rollingly engage an elongate member (e.g., a lace, a cable, a rope, a strap). For example, a suitable anchor can be configured as a roller, a sheave, a pulley, etc.

The anchors 23 can be positioned between an inner liner 13 and an inner surface (e.g., a lining 12*a*) of the outer shell 12. The anchors 23 can be fixedly coupled relative to the boot. For example, the anchors 23 can be affixed to the inner harness body 30 (FIG. 5) or to a lining 12*a* (FIG. 10) of a shell, e.g., by sewing a strap 24*a* to a selected portion of the boot 10. A corresponding retainer coupler (e.g., strap segments 22*a*, 22*b*) can be positioned inwardly of the outer shell 12.

In addition to the closure system described above (e.g., an inner closure system), some disclosed boots 10 have an outer closure system configured to supplement the constrictive and/or retention forces arising from the inner closure system. For example, opposed edges 14 of the outer shell 12 can at least partially overlie and urge against the tongue 16 and, in some instances, at least a portion of the retainer 18*a*, thereby closing the shell and tongue securely around the leg of a user.

One common type of closure system is a cable-based system. As used herein, a "cable" is a broad term that means any known pliant, flexible, relatively thin, elongate, tensionable structure that allows for routing along, through, and/or among a set of closure elements (sometimes referred to herein as constrictors) arranged on or adjacent a pair of opposed edges that are to be drawn together. In some instances, a closure element constitutes at least a portion of an eyerow. Accordingly, suitable cables may include any form of shoe or boot lace, cables of bundled metal fibers or of non-metals, strings, cords, chains, leather strips, etc. Closure elements in a cable closure system may be loops, hooks, eyelets and other such structures that can receive or otherwise operatively engage a cable. Other configurations of mechanical closure systems are also possible. For example, the closure elements may be buckles, straps (e.g., belt style or Velcro style), clamps, etc.

In the representative embodiments shown, a set of closure elements can be positioned adjacent edges 14 of the outer shell 12 that run from the front of the lower leg portion of the boot, downwardly and over the top of the foot, to the toe region of the boot. Closure systems for snowboard boots and various other kinds of boots often can be generally centered over the front of the lower leg and the top of the foot. They typically do not extend substantially beyond such centralized areas to the sides of the leg and foot.

Other Exemplary Embodiments

This disclosure describes and the drawings illustrate aspects of specific embodiments, but other embodiments may be formed and structural and logical changes may be made without departing from the intended scope of this disclosure. Directions and references (e.g., up, down, top, bottom, left, right, rearward, forward, etc.) may be used to facilitate discussion of the drawings but are not intended to be limiting. For example, certain terms may be used such as "up," "down,", "upper," "lower," "horizontal," "vertical," "left," "right," and the like. Such terms are used, where applicable, to provide some clarity of description when dealing with relative relationships, particularly with respect to the illustrated embodiments. Such terms are not, however, intended to imply absolute relationships, positions, and/or orientations. For example, with respect to an object, an "upper" surface can become a "lower" surface simply by turning the object over. Nevertheless, it is still the same surface and the object remains the same. As used herein, "and/or" means "and" or "or", as well as "and" and or.

Incorporating the principles disclosed herein, it is possible to provide a wide variety of retention system configurations. For example, features described in relation to any particular example can be combined with one or more features described in any one or more of the other examples. Accordingly, this detailed description shall not be construed in a limiting sense, and following a review of this disclosure, those of ordinary skill in the art will appreciate the wide variety of retention systems that can be devised using the various concepts described herein. Moreover, those of ordinary skill in the art will appreciate that the exemplary embodiments disclosed herein can be adapted to various configurations without departing from the disclosed principles. Thus, in view of the many possible embodiments to which the disclosed principles can be applied, it should be recognized that the above-described embodiments are only examples and should not be taken as limiting in scope. Therefore, notwithstanding that claims are not a necessary component of provisional patent applications, we reserve all rights to the subject matter disclosed herein, including the right to claim all that comes within the scope and spirit of the following paragraphs, as well as all aspects of any innovation shown or described herein.

Any patent or non-patent literature cited herein is hereby incorporated by reference in its entirety, as fully as if recited herein, for all purposes.

The previous description of the disclosed embodiments is provided to enable any person skilled in the art to make or use the disclosed innovations. Various modifications to those embodiments will be readily apparent to those skilled in the art, and the generic principles defined herein may be applied to other embodiments without departing from the spirit or scope of this disclosure. Thus, the claimed inventions are not intended to be limited to the embodiments shown herein, but are to be accorded the full scope consistent with the language of the claims, wherein reference to an element in the singular, such as by use of the article "a" or "an" is not intended to mean "one and only one" unless specifically so stated, but rather "one or more".

All structural and functional equivalents to the elements of the various embodiments described throughout the disclosure that are known or later come to be known to those of ordinary skill in the art are intended to be encompassed by the features described and claimed herein. Moreover, nothing disclosed herein is intended to be dedicated to the public regardless of whether such disclosure is explicitly recited in the claims. No claim element is to be construed as "a means plus function" claim under US patent law, unless the element is expressly recited using the phrase "means for" or "step for".

The inventors reserve all rights to the subject matter disclosed herein, including the right to claim all that comes within the scope and spirit of the following claims:

We reserve the right to claim:

1. A retention system for footwear, the retention system comprising: opposed constrictors and a tensioner configured to urge the opposed constrictors toward each other in response to a tensile force applied to the tensioner; opposed first and second anchors spaced from the tensioner;

a retainer having opposed first and second retainer couplers, wherein the first retainer coupler operatively engages the first anchor and the second retainer coupler operatively engages the second anchor such that a tensile load applied to one or both of the first and second retainer couplers urges the retainer toward one or both of the first and second anchors, wherein each of the first retainer coupler and the second retainer coupler is operatively engaged with the tensioner such that a tensile load applied to the tensioner urges the first retainer coupler and the second retainer coupler into tension and thereby urges the retainer toward one or both of the first and second anchors, and wherein:

the opposed first and second anchors comprise respective first and second apertured members;

the retainer comprises a portion of a tongue member and the opposed first and second retainer couplers comprise respective first and second strap segments outwardly extending from the tongue member and through the apertured members; and the operative engagement between the first retainer coupler and the tensioner comprises a first slidable engagement of the first strap segment with the tensioner, and the operative engagement between the second retainer coupler and the tensioner comprises a second slidable engagement of the second strap segment with the tensioner, wherein the opposed constrictors, the tensioner, and respective portions of the first and second strap segments are positioned inwardly of an inner surface of the tongue member relative to a user's foot when the footwear is donned.

2. A retention system according to claim 1, wherein:

the opposed constrictors comprise opposed first and second closure elements, and the tensioner comprises a lace operatively extending between the first and the second closure elements such that a tensile load applied to the lace urges the first and the second closure elements toward each other;

the opposed first and second retainer couplers comprise respective first and second strap segments and the opposed first and second anchors comprise respective first and second apertured members, wherein the operative engagement between the first retainer coupler and the first anchor comprises the first strap segment extending through and urging against the first apertured member.

3. A retention system according to claim 2, wherein the first and second closure elements comprise respective first and second eyerows, wherein the opposed first and second eyerows, the lace, and the first and second strap segments are positioned inwardly of at least a portion of the retainer relative to a user's foot when the footwear is donned.

4. A retention system according to claim 1, wherein the opposed constrictors comprise opposed first and second eyerows positioned adjacent respective first and second opposed edges of a harness member.

5. A retention system according to claim 1, wherein the opposed first and second anchors are fixedly coupled to the footwear such that the first and the second retainer couplers are positioned inwardly of the footwear relative to a user's foot when the footwear is donned.

6. A retention system according to claim 4, wherein the footwear comprises an outer shell and the harness member comprises an inner harness member, wherein the opposed first and second anchors are positioned between the outer shell and the inner harness member in an opposed relationship with each other.

7. A retention system for footwear according to claim 1, wherein the opposed constrictors comprise inner closure elements and the tensioner comprises an inner tensioner positioned inwardly of the retainer relative to a user's foot when the footwear is donned, wherein the retention system further comprises opposed outer closure elements and an outer tensioner, each of the opposed outer closure elements and the outer tensioner being positioned outwardly of the retainer relative to the user's foot when the footwear is donned, wherein the outer tensioner is configured to urge the opposed outer closure elements toward each other in response to a tensile force applied to the outer tensioner and thereby to supplement a retention force applied to the user's foot as a result of the tension force applied to the inner tensioner.

8. A retention system according to claim 7, wherein the opposed outer closure elements comprise respective opposed first and second outer eyerows and the outer tensioner comprises an outer lace operatively extending through the opposed first and the second outer eyerows such that a tensile load applied to the outer lace urges the first and the second outer eyerows toward each other.

9. A retention system according to claim 7, wherein: the inner closure elements comprise respective opposed first and second inner eyerows, and the inner tensioner comprises an inner lace operatively extending through the opposed first and the second inner eyerows such that a tensile load applied to the inner lace urges the first and the second inner eyerows toward each other; wherein the operative engagement between the first retainer coupler and the first anchor comprises the first strap segment extending through and urging against the first apertured member.

10. A retention system according to claim 7, wherein: the operative engagement between the first retainer coupler and the tensioner comprises a first slidable engagement of the first strap segment with the inner tensioner, and the operative engagement between the second retainer coupler and the inner tensioner comprises a second slidable engagement of the second strap segment with the inner tensioner.

11. A retention system according to claim 9, wherein the first and second strap segments are positioned inwardly of at least a portion of the retainer relative to a user's foot when the footwear is donned.

12. A retention system according to claim 7, wherein the inner closure elements comprise respective opposed first and second inner eyerows positioned adjacent corresponding first and second opposed edges of an inner harness member, the inner harness member being positioned inwardly of at least a portion of the retainer relative to a user's foot when the footwear is donned.

13. A retention system according to claim 7, wherein the opposed first and second anchors are fixedly coupled to the footwear such that the first and the second retainer couplers are positionable inwardly of the footwear relative to a user's foot when the footwear is donned.

14. A retention system according to claim 12, wherein the footwear comprises an outer shell, wherein the opposed first and second anchors are positioned between the outer shell and the inner harness member in an opposed relationship with each other.

* * * * *